US005484843A

United States Patent [19]

Mallo et al.

[11] Patent Number: 5,484,843

[45] Date of Patent: Jan. 16, 1996

[54] THICKENING WATER-IN-OIL DISPERSIONS, THEIR PREPARATION PROCESS AND THEIR USE IN TEXTILE PRINTING

[75] Inventors: Paul Mallo, Chatou; Isabelle Fietier, Choisy le Roi, both of France; Ulrich Karsunky, Hunfelden, Germany

[73] Assignee: Societe Francaise Hoechst, Puteaux, France

[21] Appl. No.: 314,708

[22] Filed: Sep. 29, 1994

[30] Foreign Application Priority Data

Sep. 29, 1993 [FR] France ..... 93 11590

[51] Int. Cl.[6] ..... C08K 5/09; C08L 1/10

[52] U.S. Cl. ..... 524/804; 524/832; 524/833; 524/842; 524/844; 524/31; 524/37; 524/44

[58] Field of Search ..... 524/804, 832, 524/833, 842, 844, 31, 37, 44

[56] References Cited

U.S. PATENT DOCUMENTS

| | | | |
|---|---|---|---|
| 4,585,815 | 4/1986 | Ono et al. | 524/44 |
| 4,594,108 | 1/1986 | Greminger, Jr. et al. | 524/44 |
| 4,631,137 | 12/1986 | Dymond | 252/8.514 |
| 5,258,429 | 11/1993 | Kniewske et al. | 524/45 |

FOREIGN PATENT DOCUMENTS 0186361 7/1986 European Pat. Off. .

OTHER PUBLICATIONS

Abstract No. 30726. "Verdickungsmittel fur Druckpasten zum Bedrucken von farbstoffaffinen Materialen." Disclosed by Ciba–Geigy AG (Basel, Switzerland). Research Disclosure No. 307, Nov. 1989, p. 789.

*Primary Examiner*—Paul R. Michl
*Assistant Examiner*—Olga Asinovsky
*Attorney, Agent, or Firm*—Browdy and Neimark

[57] ABSTRACT

Self-reversible, stable, water-in-oil dispersions, miscible with water, constituted by an oil phase, an aqueous phase and at least two emulsifying agents of which at least one is of water-in-oil type, and at least one is of oil-in-water type, which contain 20 to 50% by weight of a mixture constituted by a hydrosoluble anionic polymer belonging to the group of carboxymethylcelluloses (C), and by a cross-linked, synthetic anionic polymer, insoluble in water but water-swellable (P), based on acrylic acid (AA), partially salified with an alkali metal (M), optionally copolymerized with 2-acrylamido 2-methyl propanesulphonate of the alkali metal M (AMPSM), cross-linked with a diethylenic carboxylic acid and in which the molar ratio of the salified acid functions to the total number of free or salified acid functions is comprised between about 0.6 and about 0.9, the ratio by weight C/P+C being comprised between 0.01 and 0.4, preparation process and use for obtaining a printing paste.

20 Claims, No Drawings

THICKENING WATER-IN-OIL DISPERSIONS, THEIR PREPARATION PROCESS AND THEIR USE IN TEXTILE PRINTING

The present application relates to thickening water-in-oil dispersions, their preparation process and their use in textile printing.

In the textile industry, printed fabrics are at present experiencing a significant development. They are generally obtained by printing techniques using in particular printing pastes containing either pigments or reactive dyes and having well-defined rheological properties as a function of the article desired and the type of dye used. These rheological properties are obtained by the use of thickening agents. If in printing with pigments, it has been known for some years to use synthetic polymeric thickeners based on acrylic acid {European Patent Applications Nos. 161,038,169,674, 186,361,197,635,325,065 and 343,840), printing with reactive dyes, which is more delicate to implement and carried out in very alkaline media in the presence of a strong concentration of electrolyte, requires the use of specific thickening agents originating from natural products such as sodium alginate or guar gums with all the disadvantages inherent in these types of natural products: fluctuation in flow, difficulties of supply, variations in quality.

In order to overcome these disadvantages, the Applicant has discovered thickening compositions, usable in the printing of textiles with reactive dyes, which are stable, miscible with water and produce good-quality printing with good colour rendering, an agreeable feel and a very satisfactory uniformity.

The compositions according to the invention are self-reversible, stable, water-in-oil dispersions, miscible with water, constituted by an oil phase, an aqueous phase and at least two emulsifying agents of which at least one is of water-in-oil type, and at least one is of oil-in-water type, characterized in that they contain from 20 to 50% by weight of a mixture constituted by a hydrosoluble, anionic polymer belonging to the group of carboxymethylcelluloses, designated C, and by a cross-linked, synthetic anionic polymer, insoluble in water but water-swellable, designated P, based on acrylic acid, designated AA, partially salified with an alkali metal, designated M, optionally copolymerized with 2-acrylamido 2-methyl propanesulphonate of the alkali metal M, designated AMPSM, cross-linked with a diethylenic carboxylic acid and in which the molar ratio of the salified acid functions to the total number of free or salified acid functions is comprised between about 0.6 and about 0.9, the ratio by weight C/P+C being comprised between 0.01 and 0.4.

The expression "alkali metal M" refers to sodium or potassium. Subsequently, acrylic acid is designated AA, its alkali metal salt AAM, its sodium salt AANa, and its potassium salt AAK, 2-acrylamido 2-methyl propanesulphonic acid is designated AMPS, its alkali metal salt AMPSM, its sodium salt AMPSNa and its potassium salt AMPSK.

The expression "diethylenic carboxylic acid" refers to a cross-linking monomer, designated R, polymerizable with acrylic acid and having a carboxyl function and two ethylenic functions such as bisacrylamidoacetic acid, designated ABAA, diallyloxyacetic acid, designated DALLA.

By "emulsifying agent of water-in-oil type" is meant emulsifying agents having an HLB value (hydrophilic-lipophilic balance, Kirk-Othmer, Encyclopedia of Chemical Technology, 3rd edition, volume 8, page 910) which is low enough to provide water-in-oil emulsions such as sorbitan esters like sorbitan sesquioleates, sorbitan-monooleate.

By "emulsifying agent of oil-in-water type" is meant emulsifying agents having an HLB value which is high enough to provide oil-in-water emulsions such as ethoxylated nonylphenols, ethoxylated sorbitan esters such as sorbitan hexaoleate ethoxylated with 50 moles of ethylene oxide.

By "cross-linked" polymer is meant a non-linear polymer being presented in the form of a three-dimensional network insoluble in water but water-swellable.

The expression "carboxymethylcellulose group" refers to the products originating from the Williamson reaction with sodium chloroacetate on an alkali-cellulose (cf Ullmann's Encyclopedia of Industrial Chemistry, 5th edition, volume A5, pages 477–488) such as the products sold by the Applicant under the name TYLOSE® C. These products have a viscosity range of 100 to 4000 mPa.s. determined with a HOPPLER drop-ball viscometer at a temperature of 20° C., in solution at 2% by weight in water. Therefore TYLOSE® C 1000 refers to a sodium carboxymethylcellulose having, under the conditions defined above, an average viscosity of 1000 mPa.s. Preferably, a carboxymethylcellulose in the form of a fine powder is used.

A more particular subject of the invention is the compositions as defined above characterized in that they contain from 20 to 50% by weight of a mixture of anionic polymers constituted by 10 to 50% by weight of a carboxymethylcellulose, C, and by 90 to 50% by weight of a cross-linked polymer, P, AA-AAM-AMPSM containing in molar proportions 0 to 30% of AMPSM and 100 to 70% of an AA and AAM mixture containing in molar proportions 20 to 40% of AA and 80 to 60% of AAM, cross-linked with 0.01 to 0.06% in molar proportions relative to the monomers used, of a diethylenic carboxylic acid chosen from the group constituted by ABAA and DALLA.

Among these last-named compositions, a particular subject of the invention is the compositions as defined above in which the polymer P is cross-linked with ABAA.

Among these last-named compositions, there can be more particularly mentioned the compositions as defined above in which the polymer P is chosen from the following cross-linked polymers:

AA-AAM-AMPSM, containing in molar proportions 10 to 30% of AMPSM and 90 to 70% of acrylic acid of which 60 to 80% is in the form of an alkali metal acrylate.

AA-AAM, containing in molar proportions 30 to 40% by weight of AA and 70 to 60% of AAM.

Preferably, the compositions of the invention contain 10 to 20% by weight of a sodium carboxymethylcellulose and 20 to 30% by weight of a polymer P, as defined previously.

The compositions according to the invention contain in general 2 to 10% by weight of a mixture of emulsifying agents, and advantageously 3 to 8% by weight relative to the total weight of the composition, of which 40 to 60% is constituted by one or more emulsifying agents of water-in-oil type and 60 to 40% is constituted by one or more emulsifying agents of oil-in-water type.

The oil phase of the compositions represents 15 to 35% by weight, and advantageously 20 to 25% by weight relative to the total weight of the composition. This oil phase is constituted by a commercial mineral oil containing saturated hydrocarbons of paraffin, isoparaffin, naphthene or cycloparaffin type, having a density at 15° C. of about 0.7 to about 0.9 and a boiling point higher than 180° C., such as the white mineral oils sold by the SHELL Company or ISOPAR® sold by the EXXON Company.

The compositions according to the invention contain 25 to 60% of water in which the polymer P mixture is partially soluble. The compositions according to the invention can also contain various additives such as chelating agents, transfer agents. Advantageously, the compositions according to the invention contain 0.01 to 0.10% by weight of a chelating agent, and advantageously 0.02 to 0.5% by weight relative to the total weight of the composition of sodium diethylenetriaminepentaacetate, designated DTPANa.

Also a subject of the invention is a preparation process for the compositions defined above.

According to the invention, the compositions defined above can be prepared by a process characterized in that a radical polymerization reaction in a water-in-oil emulsion is carried out, starting with an aqueous solution containing the constitutive monomers of polymer P, and optionally a chelating agent, which is emulsified in an oil phase in the presence of one or more emulsifying agents of water-in-oil type, the polymerization reaction being initiated by the introduction into the starting emulsion of a product generating free radicals such as azo compound derivatives like azobisisobutyronitrile, designated AIBN, or a Redox pair like the cumene hydroperoxide-sodium metabisulphite pair, then, when the polymerization reaction is complete, one or more emulsifying agents of oil-in-water type and the desired quantity of anionic polymer C are introduced into the dispersion obtained, at a temperature of less than 30° C.

In a standard fashion, the polymerization reaction is carried out under agitation, under an inert atmosphere, starting with a completely deoxygenated reaction medium.

Under preferred conditions for implementing the invention, the process described above is carried out in the following manner:

polymerization is initiated with a Redox pair, at a temperature lower than or equal to 10° C., then it is taken in a quasi-adiabatic manner to a temperature higher than or equal to 60° C., the Redox pair used is the cumene hydroperoxide-sodium metabisulphite pair, at a dose of 10 to 100 molar ppm relative to the cumene hydroperoxide monomers and of 20 to 100 molar ppm relative to the sodium metabisulphite monomers.

The compositions according to the invention have useful rheological properties which are shown by determining, with a BOHLIN VOR type rheometer, the complex modulus, G*, the storage modulus, G', the loss angle, δ, of aqueous media containing them.

These useful properties justify their use in the textile industry for the preparation of printing pastes containing reactive dyes. In the following tables the various rheological characteristics as well as the properties of the fabrics printed with the printing pastes obtained from the compositions according to the invention are mentioned. These printing pastes are obtained by mixing 40 g of RB 25 REMAZOL® red sold by the Applicant, 10 g of sodium hydrogen carbonate, 50 g of urea, the required quantity of a dispersion according to the invention to give 10.6 g of anionic polymer mixture and the required quantity of water to obtain 500 g of printing paste (the printing paste therefore contains 2.12% by weight of anionic polymer mixture). The reference printing paste is prepared by mixing 40 g of RB 25 REMAZOL® red, 10 g of sodium hydrogen carbonate, 50 g of urea, 15 g of sodium alginate and the required quantity of water to obtain 500 g of printing paste.

100% cotton fabrics are printed with the printing pastes, then the feel, designated Fe, the uniformity, designated Un, and the colour rendering, designated Re, of the printed fabrics are visually determined. The rheological characteristics of these pastes are also determined with a BOHLIN VOR rheometer at ambient temperature, on a sample of 7.5 g, with a C 25HS coaxial cylinder, under the following conditions:

(i) Flow oscillation (pre-shearing at 1000 $s^{-1}$ for 5 minutes, followed by a dynamic analysis for 0.5 s at 20 Hz) conditioning of the paste followed by an instantaneous structural recovery, (ii) oscillation (dynamic analysis at 1 Hz for 1000 s), structural recovery-to equilibrium, (iii) strain sweep test (dynamic analysis at 1 Hz by strain sweep), determination of the linear range of viscoelasticity.

The following examples illustrate the invention without however limiting it.

EXAMPLE 1

An aqueous solution is prepared containing:

146 g (2.026 moles) of acrylic acid, 74.2 g (0.358 mole) of 2-acrylamido 2-methyl propanesulphonic acid, 286.9 g of an aqueous solution containing 96.6 g (1.776 mole) of potassium hydroxide, 0.9 g of an aqueous solution containing 0.36 g (0.751 mmole) of sodium diethylenetriaminepentaacetate, 0.142 g (0.715 mmole) of bisacrylamidoacetic acid and 191.8 g of water.

This aqueous solution is homogenized in an oil phase containing 250 g of SHELL S 8515 oil and 25 g of sorbitan sesquioleate for 20 minutes with a SILVERSON mixer so as to obtain a water-in-oil emulsion having a Brookfield viscosity of 3500 mPa.s. determined at 10° C. (axis 2, speed 20 rev/min, model LVT).

The emulsion thus obtained is transferred into a polymerizing machine, then it is deoxygenated by bubbling nitrogen through it and its temperature is adjusted to about 8° C. Polymerization is initiated under agitation by the introduction over 2 minutes of 0.009 g (0.0473 mmole) of cumene hydroperoxide at 80% (that being 20 molar ppm relative to the monomers) dissolved in 8 g of S 8515 oil, then after 4 minutes by the introduction over 40 minutes of 0.0136 g (0.0715 mmole) of sodium metabisulphite dissolved in 20 g of water, that being 30 molar ppm relative to the monomers. Polymerization starts at the temperature of the reaction medium and the temperature rises to 55° C., which temperature is then maintained for one hour.

The reaction medium is then progressively cooled down. At 30° C., 20 g of nonylphenol ethoxylated with 10 moles of ethylene oxide (at this stage, the dispersion obtained is designated $D_{21}$) is introduced, then at 20° C. 117.6 g of carboxymethylcellulose (TYLOSE® C 1000-HOECHST) is introduced. In this way 1140.6 g of a self-reversible, stable water-in-oil dispersion, miscible with water, is obtained, containing by weight 37.9% of water, 22.6% of oil, 3.95% of surfactants and 35.6% of an anionic polymer mixture containing by weight 29% of carboxymethyl-cellulose and 71% of an AA-AAK-AMPSK copolymer, 25.5-59.5-15 in molar proportions, cross-linked with 300 molar ppm of ABAA. This dispersion is designated $D_1$ and its rheological and application characteristics are mentioned in the following tables.

EXAMPLE 2

An aqueous solution is prepared containing 220 g (3.053 moles) of acrylic acid, 0.9 g of an aqueous solution containing 0.36 g (0.715 mmole) of sodium diethylenetriaminepentaacetate, 0.109 g (0.55 mmole) of bisacrylamidoacetic acid, 85.5 g (2.137 moles) of sodium hydroxide and 393.5 g of water.

This aqueous solution is homogenized in an oil phase containing 250 g cf SHELL S 8515 oil and 25 g of sorbitan sesquioleate as in Example 1, then the emulsion obtained is polymerized as in Example 1, using on the one hand 0.0348 g (0.183 mmole) of cumene hydroperoxide at 80% dissolved in 8 g of S 8515 oil, that being 60 molar ppm relative to the monomers and 0.029 g (0.153 mmole) of sodium metabisulphite dissolved in 20 g of water, that being 50 molar ppm relative to the monomers. At the end of the polymerization reaction, 20 g of nonylphenol ethoxylated with 10 moles of ethylene oxide is introduced under agitation into the reaction medium cooled down to 30° C. In this way a dispersion designated $D_{22}$ is obtained, into which 117.6 g of carboxymethylcellulose (TYLOSE® C 1000HOECHST) is introduced at ambient temperature, under agitation as in Example 1. In this way 1140.6 g of a self-reversible, stable, water-in-oil dispersion, miscible with water, is obtained, containing by weight 22.62% of oil, 3.94% of surfactants, 39.7% of water and 33.73% of an anionic polymer mixture containing by weight 30.57% of carboxymethylcellulose and 69.43% of an AA-AANa copolymer, 30–70 in molar proportions, cross-linked with 180 molar ppm of ABAA. This dispersion is designated Ds and its rheological and application characteristics are mentioned in the following tables. In another test, TYLOSE® C 1000 is replaced with TYLOSE® C 300, and the dispersion designated $D_{32}$ is obtained.

EXAMPLE 3

An aqueous solution is prepared containing 165.25 g (2.2932 moles) of acrylic acid, 52.79 g (0.2547 mole) of 2-acrylamido 2-methyl propanesulphonic acid, 104.25 g (1.858 mole) of potassium hydroxide, 0.9 g of an aqueous solution containing 0.36 (0.751 mmole) of sodium diethylenetriaminepentaacetate, 0.151 g (0.7619 mmole) of bisacrylamidoacetic acid and 386.7 g of water. This aqueous phase with a total weight of 710 g is homogenized in an oil phase constituted by 240 g of ISOPAR® M oil (d=0.79, b.p.=206°–250° C.) and 24 g of sorbitan sesquioleate as in Example 1, then the emulsion obtained is polymerized as in Example 1, using on the one hand 0.01 g (0.0525 mmole) of cumene hydroperoxide at 80% dissolved in 8 g of ISOPAR® M oil, that being 20 molar ppm relative to the monomers, and 0.0145 g (0.0763 mmole) of sodium metabisulphite dissolved in 20 g of water, that being 30 molar ppm relative to the monomers. At the end of the polymerization reaction, 20 g of nonylphenol ethoxylated with 10 moles of ethylene oxide is introduced under agitation into the reaction medium cooled down to 30° C. In this way a dispersion designated $D_{23}$ is obtained, into which 117.5 g of TYLOSE® C 1000 is introduced at ambient temperature under agitation. In this way 1139.5 g of a self-reversible, stable, water-in-oil dispersion, miscible with water, is obtained, containing by weight 21.76% of oil, 3.86% . of surfactants, 38.72% of water and 35.66% of an anionic polymer mixture containing by weight 28.9% of carboxymethylcellulose and 71.1% of an AA-AAK-AMPSK polymer, 27-63-10 in molar proportions, cross-linked with 300 molar ppm of ABAA relative to the monomers. This dispersion is designated $D_3$ and its rheological and application characteristics are mentioned in the following tables. In another test, TYLOSE® C 1000 is replaced with TYLOSE® C 300, and in this way a dispersion designated $D_{33}$ is obtained.

EXAMPLE 4

Example 2 is reproduced, starting with an aqueous solution containing 220 g (3.053 mole) of acrylic acid, 0.9 g of an aqueous solution containing 0.36 g (0.715 mole) of sodium diethylenetriaminepentaacetate, 0.109 g (0.550 mmole) of bisacrylamidoacetic acid, 73.27 g (1.832 mole) of sodium hydroxide and 405.7 g of water. In this way 1140.6 g of a self-reversible, stable, water-in-oil dispersion, miscible with water, is obtained, containing by weight 22.62% of oil, 3.94% of surfactants, 40.31% of water and 33.13% of an anionic polymer mixture containing by weight 31.12% of carboxymethylcellulose and 68.88% of an AA-AANa copolymer, 40–60 in molar proportions, cross-linked with 240 molar ppm of ABAA relative to the monomers. This dispersion is designated $D_4$; the intermediate dispersion obtained before the introduction of the carboxymethylcellulose is designated $D_{24}$. The rheological and application characteristics of these dispersions are mentioned in the following tables.

EXAMPLE 5

Example 1 is reproduced, using on the one hand 0.012 g (0.565 mmole) of ABAA (240 molar ppm relative to the monomers), and on the other hand an aqueous phase containing in total 424 g of water instead of 432 g. In this way, after addition of 116.7 g of TYLOSE® C 1000, 1131.7 g of a dispersion designated $D_5$ is obtained, containing by weight 4% of surfactants, 22.8% of oil, 37.5% of water and 35.8% of an anionic polymer mixture containing by weight 28.8% of carboxymethylcellulose and 71.2% of an AA-AAK-AMPSK copolymer, 25.5-59.5-15 in molar proportions, cross-linked with 240 molar ppm of ABAA. The intermediate dispersion before the introduction of the carboxymethylcellulose is designated $D_{25}$. In another test, 165.4 g of TYLOSE® C 1000 is used instead of 116.7 g. In this way 1189.4 g of a dispersion, designated $D_{45}$, is obtained. The rheological and application characteristics of these dispersions are mentioned in the following tables.

EXAMPLE 6

Example 2 is reproduced, using on the one hand 0.145 g (0.7316 mmoles) of ABAA (240 molar ppm relative to the monomers) and on the other hand an oil phase containing 225 g of S 8515 oil and 22.5 g of sorbitan sesquioleate. In this way, after addition of 114.5 g of TYLOSE® C 1000, 1110 g of a dispersion designated $D_6$ is obtained, the intermediate dispersion before the introduction of the carboxymethylcellulose is designated $D_{26}$. In another test, 229 g of TYLOSE® C 1000 is introduced into dispersion $D_{26}$ and 1224.5 g of a dispersion designated $D_{46}$ is obtained. The theological and application characteristics of these dispersions are mentioned in the following tables.

In tables I to III, the abbreviations used have the following meanings:

Ex: example.

ABAA % ppm: indicates the number of moles of ABAA per $10^6$ moles of monomers.

C: anionic polymer, of sodium carboxymethylcellulose type, C 1000 indicates TYLOSE® C 1000 and C 300 indicates TYLOSE® C 300, sold by the Applicant; their percentage by weight is calculated relative to the total weight of the composition according to the invention.

The percentages by weight of the polymers present in the composition of the invention are expressed as dry weight. Therefore, 35.6 indicated for dispersion $D_1$ of table I means that the composition contains 35.6% of an anionic polymer mixture, of which 10.31% relative to the total weight of the composition is TYLOSE® C 1000, and consequently 35.6–10.3=25.3% of an AA-AAK-AMPSK polymer, 25.5-59.5-15.

SF: surfactants present in the composition.

Ref: indicates a printing paste prepared with sodium alginate as indicated in the present description.

The printing characteristics are graded from 0 to 5, from bad to excellent, mark 3 is the quality obtained with a conventional paste prepared with sodium alginate.

G*: complex modulus, it is expressed in Pascals.

δ: loss angle, it is expressed in degrees and it is calculated by the relationship: tan δ=G"/G' where G' represents the storage modulus and G" the loss modulus.

Dispersions $D_{21}$, $D_{22}$, $D_{23}$, $D_{24}$, $D_{25}$ and $D_{26}$ are dispersions used to prepare the compositions of the invention; their characteristics are indicated as a comparison.

By analysis of table III it can be noted that the printing pastes produced with the compositions of the invention have application properties superior than or equal to those obtained by the use of printing pastes prepared either in the conventional manner with sodium alginate, or solely with synthetic polymers based on acrylic acid.

TABLE III

| | Rheology | | Printing characteristics | | |
|---|---|---|---|---|---|
| N° | G* (Pa) | δ (°) | Fe | Re | Un |
| Ref | 7 | 85 | 3 | 3 | 3 |
| $D_{21}$ | 56 | 10 | 3 | 3 | 3 |
| $D_1$ | 12 | 37 | 3 | 4 | 3 |
| $D_{22}$ | 16 | 28 | 3 | 3 | 3 |
| $D_2$ | 7 | 44 | 3 | 5 | 3 |
| $D_{32}$ | 6 | 50 | | | |
| $D_{23}$ | | | | | |
| $D_3$ | 8 | 37 | 3 | 4 | 3 |
| $D_{33}$ | 16 | 29 | 3 | 4 | 3 |
| $D_{24}$ | 6 | 73 | 3 | 3 | 3 |
| $D_4$ | 4 | 70 | 3 | 5 | 3 |
| $D_{25}$ | 86 | 12 | | | |
| $D_5$ | 12 | 38 | 3 | 4 | 3 |
| $D_{45}$ | 13 | 40 | 3 | 4 | 3 |
| $D_{26}$ | 10 | 42 | 3 | 3 | 3 |
| $D_6$ | 7 | 52 | 3 | 4 | 3 |
| $D_{46}$ | 5 | 56 | 3 | 5 | 3 |

We claim:

1. Self-reversible, stable, water-in-oil dispersion, miscible with water, constituted by an oil phase, an aqueous phase and at least two emulsifying agents of which at least one is of water-in-oil type, and at least one is of oil-in-water type, characterized in that it contains 20 to 50% by weight of a mixture constituted by a hydrosoluble anionic polymer belonging to the group of carboxymethylcelluloses, designated C, and by a cross-linked, synthetic anionic polymer, insoluble in water but water-swellable, designated P, based on acrylic acid, designated AA, partially salified with an alkali metal, designated M, optionally copolymerized with 2-acrylamido 2-methyl propanesulphonate of the alkali metal M, designated AMPSM, cross-linked with a diethylenic carboxylic acid and in which the molar ratio of the

TABLE I

| No. | | Molar composition of P | | | C | | Composition by weight of dispersion | | | |
|---|---|---|---|---|---|---|---|---|---|---|
| Example | D | Nature | molar % | ABAA % ppm | Nature | % by weight | Oil | Water | Sf | Polymer |
| Ex 1 | $D_{21}$ | AA-AAK-AMPSK | 25.5-59.5-15 | 300 | 0 | 0 | 25.2 | 42.2 | 4.4 | 28.1 |
| | $D_1$ | AA-AAK-AMPSK | 25.5-59.5-15 | 300 | C 1000 | 10.31 | 22.6 | 37.9 | 3.9 | 35.6 |
| Ex 3 | $D_{23}$ | AA-AAK-AMPSK | 27-63-10 | 300 | 0 | 0 | 24.3 | 43.1 | 4.3 | 28.3 |
| | $D_3$ | AA-AAK-AMPSK | 27-63-10 | 300 | C 1000 | 10.31 | 21.8 | 38.7 | 3.9 | 35.7 |
| | $D_{33}$ | AA-AAK-AMPSK | 27-63-10 | 300 | C 300 | 10.31 | 21.8 | 38.7 | 3.9 | 35.7 |
| Ex 5 | $D_{25}$ | AA-AAK-AMPSK | 25.5-59.5-15 | 240 | 0 | 0 | 25.4 | 41.8 | 4.4 | 28.4 |
| | $D_5$ | AA-AAK-AMPSK | 25.5-59.5-15 | 240 | C 1000 | 10.31 | 22.8 | 37.4 | 4.0 | 35.8 |
| | $D_{45}$ | AA-AAK-AMPSK | 25.5-59.5-15 | 240 | C 1000 | 14.02 | 21.9 | 35.9 | 3.8 | 38.4 |

TABLE II

| No. | | Molar composition of P | | | C | | Composition by weight of dispersion | | | |
|---|---|---|---|---|---|---|---|---|---|---|
| Example | D | Nature | molar % | ABAA % ppm | Nature | % by weight | Oil | Water | Sf | Polymer |
| Ex 2 | $D_{22}$ | AA-AANa | 30-70 | 180 | 0 | 0 | 25.2 | 44.3 | 4.4 | 26.1 |
| | $D_2$ | AA-AANa | 30-70 | 180 | C 1000 | 10.31 | 22.6 | 39.7 | 3.9 | 33.7 |
| | $D_{32}$ | AA-AANa | 30-70 | 180 | C 300 | 10.31 | 22.6 | 39.7 | 3.9 | 33.7 |
| Ex 4 | $D_{24}$ | AA-AANa | 40-60 | 180 | 0 | 0 | 25.2 | 44.9 | 4.4 | 25.4 |
| | $D_4$ | AA-AANa | 40-60 | 180 | C 1000 | 10.31 | 22.6 | 40.3 | 3.9 | 33.1 |
| Ex 6 | $D_{26}$ | AA-AANa | 30-70 | 240 | 0 | 0 | 23.4 | 45.5 | 4.3 | 26.8 |
| | $D_6$ | AA-AANa | 30-70 | 240 | C 1000 | 10.31 | 21 | 40.8 | 3.8 | 34.4 |
| | $D_{46}$ | AA-AANa | 30-70 | 240 | C 1000 | 18.7 | 19 | 37 | 3.5 | 40.5 |

salified acid functions to the total number of free and salified acid functions is between about 0.6 and about 0.9, the ratio by weight C/P+C being between 0.01 and 0.4.

2. Dispersion according to claim 1, characterized in that it contains from 20 to 50% by weight of a mixture of anionic polymers constituted by 10 to 50% by weight of a carboxymethylcellulose, C, and by 90 to 50% by weight of a cross-linked polymer, P, AA-AAM-AMPSM containing in molar proportions 0 to 30% of AMPSM and 100 to 70% of an AA and AAM mixture containing in molar proportions 20 to 40% of AA and 80 to 60% of AAM, cross-linked with 0.01 to 0.06% in molar proportions relative to the monomers used, of a diethylenic carboxylic acid chosen from the group constituted by bisacrylamidoacetic acid and diallyloxyacetic acid.

3. Dispersion according to claim 2, characterized in that the polymer P is cross-linked with bisacrylamidoacetic acid.

4. Dispersion according to claim 3, characterized in that the polymer P is a cross-linked polymer, AA-AAM-AMPSM, containing in molar proportions 10 to 30% of AMPSM and 90 to 70% of acrylic acid and of which 60 to 80% are in the form of an alkali metal acrylate.

5. Dispersion according to claim 3, characterized in that the polymer P is a cross-linked polymer, AA-AAM, containing in molar proportions 30 to 40% of AA and 70 to 60% of AAM.

6. Dispersions according to claim 5, characterized in that it contains by weight 10 to 20% of a sodium carboxymethylcellulose and 20 to 30% of a polymer P.

7. Process for obtaining a dispersion according to claim 1, characterized in that a radical polymerization reaction in a water-in-oil emulsion is carried out, starting with an aqueous solution containing the constitutive monomers of polymer P, and optionally a chelating agent, which is emulsified in an oil phase in the presence of one or more emulsifying agents of water-in-oil type, the polymerization reaction being initiated by the introduction into the starting emulsion of a product generating free radicals or a Redox pair, then, when the polymerization reaction is completed, one or more emulsifying agents of oil-in-water type and the desired quantity of anionic polymer C are introduced into the dispersion obtained, at a temperature of less than 30° C.

8. Process according to claim 7, characterized in that the polymerization is initiated by a Redox pair, at a temperature lower than or equal to 10° C., then it is taken in a quasia-diabatic manner to a temperature higher than or equal to 60° C.

9. Process according to claim 8, characterized in that the polymerization reaction is initiated by a cumene hydroperoxide-sodium metabisulphite Redox pair, at a dose of 10 to 100 molar ppm relative to the cumene hydroperoxide monomers and of 20 to 100 molar ppm relative to the sodium metabisulphite monomers.

10. Dispersion according to claim 1, characterized in that the polymer P is cross-linked with bisacrylamidoacetic acid.

11. Dispersion according to claim 10, characterized in that the polymer P is a cross-linked polymer, AA-AAM-AMPSM, containing in molar proportions 10 to 30% of AMPSM and 90 to 70% of acrylic acid and of which 60 to 80% are in the form of an alkali metal acrylate.

12. Dispersion according to claim 11, characterized in that it contain by weight 10 to 20% of a sodium carboxymethylcellulose and 20 to 30% of a polymer P.

13. Dispersion according to claim 4, characterized in that it contains by weight 10 to 20% of a sodium carboxymethylcellulose and 20 to 30% of a polymer P.

14. Dispersion according to claim 1, characterized in that the polymer P is a cross-linked polymer, AA-AAM-AMPSM, containing in molar proportions 10 to 30% of AMPSM and 90 to 70% of acrylic acid and of which 60 to 80% are in the form of an alkali metal acrylate.

15. Dispersion according to claim 10, characterized in that the polymer P is a cross-linked polymer, AA-AAM, containing in molar proportions 30 to 40% of AA and 70 to 60% of AAM.

16. Dispersion according to claim 1, characterized in that the polymer P is a cross-linked polymer, AA-AAM, containing in molar proportions 30 to 40% of AA and 70 to 60% of AAM.

17. Dispersion according to claim 16, characterized in that it contains by weight 10 to 20% of a sodium carboxymethylcellulose and 20 to 30% of a polymer P.

18. Dispersion according to claim 1, characterized in that it contains by weight 10 to 20% of a sodium carboxymethylcellulose and 20 to 30% of a polymer P.

19. Process according to claim 7, characterized in that the polyermization reaction is initiated by a cumene hydroperozide-sodium metabisulphite Redox pair, at a dose of 10 to 100 molar ppm relative to the cumene hydroperoxide monomers and of 20 to 100 molars ppm relative to the sodium metabisulphite monomer.

20. In a method for thickening a reactive dye in order to make a printing paste, comprising mixing such a reactive dye with a thickening agent, the improvement wherein said thickening agent comprises a dispersion according to claim 1.

* * * * *